United States Patent [19]

Burns, Jr. et al.

[11] 4,353,706

[45] Oct. 12, 1982

[54] PROCESS FOR PRODUCING SCULPTURED PILE FABRIC

[75] Inventors: Alonzo M. Burns, Jr., Inman; Woodrow P. Gilbert, Spartanburg, both of S.C.

[73] Assignee: Milliken Research Corporation, Spartanburg, S.C.

[21] Appl. No.: 141,036

[22] Filed: Apr. 17, 1980

[51] Int. Cl.[3] ..... D06Q 1/02

[52] U.S. Cl. ..... 8/114.6

[58] Field of Search ..... 8/114.6

[56] References Cited

U.S. PATENT DOCUMENTS

| | | | |
|---|---|---|---|
| 556,794 | 3/1896 | Wessel | 8/114.6 |
| 705,977 | 7/1902 | Timme | 8/114.6 |
| 1,718,409 | 6/1929 | Brett | 8/114.6 |
| 1,818,505 | 8/1931 | Rivat et al. | 8/114.6 |
| 1,980,191 | 11/1934 | Dickie et al. | 8/114.6 |
| 2,110,866 | 3/1938 | Castles | 28/1 |
| 2,307,118 | 1/1945 | Doring et al. | 8/114.6 |
| 2,875,504 | 3/1959 | White | 428/89 |
| 3,567,548 | 3/1971 | Miller | 428/96 |
| 3,743,478 | 7/1973 | Sando et al. | 8/114.6 |
| 3,797,996 | 3/1974 | Gregorian et al. | 8/114.5 |
| 3,830,683 | 8/1974 | Bohrn | 428/92 |
| 3,849,157 | 11/1974 | Palmer et al. | 428/89 |
| 3,849,158 | 11/1974 | Palmer et al. | 8/570 |
| 3,856,598 | 12/1974 | Gregorian et al. | 428/89 |
| 3,880,581 | 4/1975 | Gregorian et al. | 8/114.5 |
| 3,945,791 | 3/1976 | Bohrn | 8/114.5 |
| 3,953,164 | 4/1976 | Boba et al. | 8/115 |
| 3,961,882 | 6/1976 | Vits et al. | 8/929 |
| 4,084,615 | 4/1978 | Klein et al. | 137/624.11 |

FOREIGN PATENT DOCUMENTS 1047902 2/1979 Canada .

*Primary Examiner*—Maria P. Tungol

*Attorney, Agent, or Firm*—H. William Petry; Terry T. Moyer

[57] ABSTRACT

A process for sculpturing a pile fabric, e.g., nylon pile fabric, is provided which comprises selectively contacting the pile surface of said fabric with a fiber degrading composition, said composition comprising a fiber degrading agent in a concentration sufficient to reduce the tensile strength of the fibers of the pile in the selected areas so that said pile fibers may be removed by mechanical action; said fiber degrading agent being an aromatic sulfonic acid having a pK value of from about 0.1 to about 2, and said fiber degrading composition further containing a diluent for said fiber degrading agent; heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric. Products made according to the process are also provided.

15 Claims, No Drawings

PROCESS FOR PRODUCING SCULPTURED PILE FABRIC

The present invention relates to a sculptured pile fabric and to a process for producing such fabrics. More particularly, the present invention relates to a sculpturing process wherein the tensile strength of the fibers of the portions of the pile desired to be sculptured is reduced so that the pile may be removed in those selected areas by mechanical means.

In the production of pile fabrics, it is often desirable to provide a sculptured effect on the surface thereof in order to enhance decorative appeal. One of the early attempts to achieve such sculptured effect was by means of a heated embossing roll or plate which has been engraved or otherwise treated to create a desired design in raised relief on the surface of the pile fabric. Methods which have been proposed for the elimination of the use of embossing rolls include those disclosed in U.S. Pat. Nos. 2,790,255 and 2,875,504. As disclosed in these patents, the pile fabric is formed from a combination of shrinkable and nonshrinkable yarns; and upon subjecting the fabric to the influence of heat, the pile formed from the shrinkable yarns contracts while the base and nonshrinkable yarns remain intact, thereby yielding a pile having high and low areas to provide the appearance of an embossed or carved product.

Other sculpturing methods employing shrinking of the fibers by chemical means are known. It has thus been suggested, for instance, that pile fabrics, made from nylon carpet fibers having a textured or embossed surface, may be prepared by selectively contacting the surface of the carpet with a chemical fiber shrinking agent therefor, the shrinking serving to reduce the height of the pile in the treated areas, thereby creating a textured surface. In this regard, U.S. Pat. No. 3,849,157 discloses the use of an embossing agent blended into a liquid base vehicle containing a metal halide such as zinc chloride and an acid such as acetic acid which causes shrinkage of the pile fibers in the selected areas where it is applied. A similar process for providing an embossed effect on nylon pile fabric is disclosed in U.S. Pat. No. 3,849,158 where an embossing agent such as benzotriazole, hydroxyacetic acid, or formic acid, etc. causes a sculptured effect when it is applied by shrinking selected areas.

U.S. Pat. No. 3,856,598 discloses a process for producing texturized effects in a three component laminate which comprises applying a shrinking agent to the fibrous component of the laminate, drying the fabric and washing the fabric. The patent discloses many types of shrinking agents which may be used depending upon the nature of the components of the laminate. With regard to nylon, the shrinking agent is disclosed to be an acidic material having a dissociation constant greater than about $2\times10^{-5}$, such as mono and polybasic inorganic acids and organic acids, such as acrylic acid, formic acid, monochloroacetic acid, o-chlorobenzoic acid and even sulfonic acids, such as p-toluene sulfonic acid, benzene sulfonic acid, and phenols, such as m-cresol, and p-chlorophenol (col. 4, lines 47–59). The patent emphasizes that the acid should be selected so as to minimize fiber degradation (col. 4, lines 60–64).

A second category of what may conveniently be termed "chemical sculpturing methods" employs complete dissolution of the pile fibers which come into contact with the applied chemical-sculpturing agent.

Exemplary of what may be called the chemical fiber-dissolving type of sculpturing are the processes disclosed in U.S. Pat. Nos. 3,567,548 and 3,830,683. In the former patent a process is disclosed for the sculpturing of pile fibers, e.g., acrylic and polyester, by depositing polar solvent-containing solutions for the fiber in the pile, such as dimethyl formamide and dimethyl sulfoxide, having a viscosity of 500 to 1000 cps. According to the process a deep contour is provided in the fabric by totally dissolving portions of the pile fabric to which the solution has been applied. Similarly U.S. Pat. No. 3,830,683 discloses a process for embossing or sculpturing a tufted pile fabric printed with a decorative pattern. According to the disclosure the ink formulation used for printing the fabric contains a solvent for the carpet and the printing step is immediately followed by a steaming step, resulting in a combination of fiber shrinkage and dissolving to produce an embossed effect. The carpet may then be washed and dried to provide a carpet product having an embossed design.

Unfortunately, however, there have been problems associated with the use of the known methods for sculpturing pile fabrics that have prevented the production of a product at a reasonable price that is of very good quality. Use of a heated embossing roll results in the partial or complete melting of the embossed areas. Fibers may lose their individual integrity and become bonded together. The feel or hand of the embossed areas is often harsh and undesirable. The more recent embossing techniques have not been completely successful in overcoming these problems. Those processes which employ a chemical shrinking agent for the embossed areas have been generally unsatisfactory since the embossed areas tend to have a harsh and undesirable hand. Use of solvents to dissolve selected areas has been largely unsuccessful since the solvent may destroy the entire pile length in the areas to be embossed thereby exposing the backing of the fabric which may not be desired. Even if total dissolution of the pile is avoided fiber integrity may be destroyed and a harsh, undesirable hand may be the inevitable result.

Also, where shrinkage of the pile fibers is employed as the means for providing a sculptured effect, reduction in the overall pile height in general may not exceed more than about 40 percent without resulting in an undesirable loss of the fiber integrity and resultant undesirable hand and appearance. Such limitation may render the shrinking processes unusable where it is necessary or desirable to remove more than about 40 percent of the pile to achieve the desired aesthetic effect. This is particularly noticeable where the sculptured effect is desired in register with a printed pattern on the pile fabric where pile height reduction of 40 percent or less would not create a sufficiently striking visual effect to be of significant commercial importance. With fabrics having printed patterns it may be necessary to remove more than about 40 percent of the pile length in selected areas, e.g., 50 percent or even more, to provide the desired visual effect.

Accordingly, the present invention provides a process for sculpturing pile fabrics wherein loss of individual fiber integrity in the embossed areas is avoided. The length of pile remaining in the embossed areas may be controlled so that, if desired, only a portion of the pile may be removed, or optionally the entire exposed portion of the pile may be removed as desired. Superior pile fabrics, e.g., nylon pile fabrics, may be provided having sculptured or textured surfaces with a superior hand by means of a process that is adaptable to standard known equipment for selectively dyeing pile fabrics in a pattern. The process which has been discovered also allows the production of nylon pile fabric having sculptured areas in register with a printed design. The products of the present invention not only have superior hand characteristics in the sculptured areas but also, surprisingly, they may, as a result of the sculpturing process, be provided with differential dyeability characteristics in the sculptured versus the non-sculptured areas so that upon dyeing an enhanced visual effect may be provided.

According to the present invention a process for sculpturing a pile fabric, e.g., nylon pile fabric, is provided which comprises selectively contacting the pile surface of the fabric with a fiber degrading composition, said composition comprising a fiber degrading agent in a concentration sufficient to reduce the tensile strength of the fibers of the pile in the selected areas so that said pile fibers may be removed by mechanical action; said fiber degrading agent being an aromatic sulfonic acid having a pK value of from about 0.1 to about 2, and said fiber degrading composition further containing a diluent for said fiber degrading agent; heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric.

Products made according to the above process are also within the scope of the present invention. As already mentioned, the products made according to the invention have very desirable hand characteristics in the sculptured areas. It has also been discovered quite surprisingly that application of the fiber degrading composition to the selected areas to be sculptured results in sufficient modification of the pile and/or base fabric remaining in the sculptured areas so that differential dyeability characteristics between the sculptured and non-sculptured areas are observed. This characteristic further enhances the visual appeal of the products since, for instance, by the application of only one dye to the fabric a non-uniformly colored product may be provided. Even where more than one dye is applied the visual effect resulting from this differential dyeability characteristic in the sculptured and non-sculptured areas may provide an enhanced visual appeal in the fabric product.

The pile fabrics which may be processed according to the present invention include virtually all pile fabrics, e.g., pile carpeting, upholstery fabrics and the like. A wide variety of both natural and synthetic fibers as well as blends of such fibers may be processed according to the present invention. Examples of such pile fibers include synthetic fibers, prepared from polyamides or nylons which are well known to those skilled in the art and polyester, natural fibers such as wool and blends of these fibers.

The preferred pile fibers employed in the process of the invention include nylon, wool and nylon wool blends. Synthetic fibers prepared from polyamides or nylon are well known to those skilled in the art and as these terms are employed herein are intended to include any long chain synthetic polymeric amide which has recurring amide groups as integral part of the main polymer chain and which is capable of being formed into a filament in which the structural elements are oriented in the direction of the axis of that chain.

Polyamide resins coming within this definition and contemplated in the practice of the present invention are formed generally by reaction of the dicarboxylic acid with a diamine or by the self-condensation of an aminocarboxylic acid. Illustrative of these polyamide resins are nylon 66, prepared by the condensation of hexamethylenediamine and adipic acid; nylon 610 prepared from hexamethylenediamine and sebacic acid, both of the foregoing having, as prepared, molecular weights of approximately 20,000 to 50,000 or more; nylon-6 produced by thermal polymerization of epsilon-aminocaproic acid or caprolactam; nylon-11, the self-condensation production of 11-aminoundecanoic acid; as well as a variety of polymers prepared from polymerized, dibasic acids and polyamine compounds. The most preferred pile fibers have been found to be nylon 66, wool and nylon wool blends.

The fiber degrading composition of the process is applied to the pile fibers in order to produce the desired sculptured effect. The fiber degrading composition contains a fiber degrading agent as the primary active component of the composition. For purposes of this invention, the term "fiber degrading composition" may be defined as any active chemical compound or composition which when applied to the pile fabric causes the portion of the pile to which it has been applied to become brittle or to result in substantial reduction of the tensile strength of the portion of the fiber to which it is applied without actually dissolving the fiber so that the degraded portion of the pile can be removed at a later stage in the process by mechanical means.

Thus, it will be understood that as compared to prior known techniques for creating a sculptured or embossed effect on pile fabrics such as those disclosed in U.S. Pat. Nos. 3,849,157 and 3,849,158, the composition applied pursuant to the present invention in fact results in reducing the tensile strength of the fibers of the pile or portion of the pile to which it comes in contact but by contrast to the teachings of those references, does not result in any substantial shrinkage of the pile which, according to the present invention, is not desired. By contrast to those references which disclose dissolution of the pile, the fiber degrading composition is not a solvent for the pile fibers, that is, it does not remove the undesired fibers by simply dissolving them. The fiber degrading composition should be sufficiently active to result in reduction of the tensile strength of the desired areas and portion of the pile fabric while at the same time it should not be so active as to completely destroy or remove the desired area and portion of the pile prior to subsequent processing as will be fully described herein. The composition should be capable of being substantially removed or at least inactivated subsequent to the sculpturing steps. Other characteristics of the sculpturing composition which are desirable include compatibility with various dyes, thickeners, capability of being regulated by factors of the time, temperature, and concentration, i.e., susceptibility to activation by heating, for instance by conventional steaming operation, and exhibiting no residual sculpturing activity.

The fiber degrading composition which is applied to the pile fibers to obtain the desired sculptured effect contains a fiber degrading agent for the pile of the fabric. The fiber degrading agent should be present in the composition in a concentration sufficient to reduce the tensile strength of the fibers so that the fibers may be removed after the application of heat by mechanical means. The concentration of the sculpturing agent should not be so high as to result in complete destruction of the fiber integrity prior to subsequent removal thereof by mechanical means. It has been found that the fiber degrading agent may preferably be present in the fiber degrading composition in an amount of from about 10 percent to 70 percent, preferably from about 20 percent to 50 percent by weight based upon the weight of the fiber degrading composition.

The fiber degrading agents useful in the process of the present invention include aromatic sulfonic acids having a pK value of from about 0.1 to about 2, preferably from about 0.4 to about 1. Examples of suitable fiber degrading agents include benzene sulfonic acid, naphthalene sulfonic acid, ortho-, meta-, and para-toluenesulfonic acids, alkylated aromatic sulfonic acids wherein the alkyl group may be straight chain or branched chain and may contain from one to about 20 carbon atoms. Dodecylbenzene sulfonic acid is an example of a preferred alkylated aromatic sulfonic acid.

The fiber degrading agent is an aromatic sulfonic acid and examples of such acids have been provided above. In general, it is believed that the fiber degrading agent may also be characterized as having a size of the individual molecules that is such that the molecules will selectively penetrate areas of the individual pile fibers of relatively low crystallinity so that hydrolysis of the fiber will occur in those areas. If the molecule is too large sufficient contact between the fiber degrading agent and the areas of low crystallinity may not be achieved. If the molecule is too small in size the agent may not attack selectively but may attack both crystalline and non-crystalline areas of the pile resulting in undesired total destruction rather than selective degradation of the pile. This latter result is not desired since it has been observed that total destruction of the pile at this stage of the process provides an undesirable product having a relatively harsh and unappealing hand in the embossed areas, which is a characteristic of the prior art techniques described herein and which the present process is designed to avoid.

It should, of course, also be understood that the molecular weight and dissociation constant of the fiber degrading agent will vary somewhat depending on the composition of the fibers in the pile fabric to be sculptured, since different fiber compositions will have different crystallization characteristics and will react differently to attack by the fiber degrading agent.

The fiber degrading agent is present in the fiber degrading composition together with a suitable diluent. The diluent may be a solvent for the fiber degrading agent, or alternatively if the agent is not soluble it should be present in the composition in a finely divided form, that is, it should be present in a micro-pulverized form which indicates particle diameter in the order of 100 microns or smaller, preferably even 20 microns or smaller. Such dispersion will assure that the agent becomes universally dispersed over the fiber during the process in the desired areas so that the degrading effect will be uniformly developed on the desired portions or all of the fiber. The fiber degrading composition may preferably include predominant amounts of water as a solvent for the fiber degrading agent, although other solvents, e.g., water, including methanol and ethanol may be employed. In any event it is believed that the alteration of the tensile strength of the fiber is caused by a hydrolysis reaction which results in breakage of the bonds of the molecules which make up the fiber. Thus hydrogen ions must be present at the site of the reaction together with the fiber degrading agent, and this may be conveniently accomplished by using water as a solvent.

The composition may further include a thickening agent, e.g., natural and synthetic gums and cellulose derivatives, by means of which the viscosity of the composition may be varied in a manner well known in the art in order to obtain the viscosity characteristics demanded in print technology and to enable the fiber degrading agent to adhere to and operate on the fiber and to hold the printed patterns. In general the viscosity of the composition may preferably be from about 100 to about 1000 cps, at 25° C., as measured by a Brookfield No. 3 spindle at 30 rpm.

The fiber degrading composition may be applied to the pile fabric in an amount of from about 50 percent to 500 percent, preferably 150 percent to 250 percent, by weight based upon the weight of the area of substrate to be sculptured. The fiber degrading composition may be applied to the pile fabric in the form of a substantially transparent composition so that the only alteration of the product is the sculpturing effect. Alternatively, the fiber degrading composition may be part of a dye or pigment composition used in printing the fabric so that the color appears in perfect register where the fiber degrading composition has been selectively applied. The dye or pigment may generally be in the form of a printing paste ink to which the appropriate amount of agent is added. In preparing such modified dye compositions, viscosities, and dye concentration which are essential to an efficient dyeing operation must also be controlled. The resultant effect is an embossed design in register with the printed pattern with color in the printed areas.

With regard to the selected areas where the fiber degrading agent has been applied, the extent of pile removal and hence the depth of sculpturing may be controlled by varying the amount of fiber degrading composition applied or by varying the concentration of fiber degrading agent in the fiber degrading composition, or both. Furthermore, the amount of pile removed in the selected areas can also be controlled to a certain extent by the depth of penetration of the composition containing the fiber degrading agent into the pile of the fabric. Penetration can be controlled by varying, for instance, the viscosity of the chemical fiber degrading composition.

Application of the fiber degrading composition to the pile fabric may be accomplished by utilizing one of the many types of known printing apparatus thereby eliminating the need for expensive embossing or sculpturing equipment. Furthermore, it allows the sculpturing of a surface without exerting such pressure on the pile to result in permanent deformation of the fabric pile. In addition, because the sculpturing results from the removal of portions of the pile rather than by shrinkage of the pile in selected areas, the product typically has a much softer hand than would otherwise be provided for a given depth of sculpturing; and, also, exhibits all the advantages of products made by range printing techniques as opposed to woven fabric or hand sculptured fabric. The preferred apparatus for application of the fiber degrading composition may be a jet dyeing apparatus such as that disclosed in U.S. Pat. No. 4,084,615 to Norman E. Klein and William H. Stewart, assigned to Milliken Research Corporation, the disclosure of which is hereby incorporated herein by reference.

After the fiber degrading composition has been applied to the pile fabric, the fabric is heated to a temperature sufficient to cause a substantial reduction of the tensile strength of the fibers, generally temperatures of from about 120° F. to about 250° F. may be employed. Steam may be conveniently used for this purpose, and if it is desired to employ elevated temperatures above 212° F. in steaming, super-heated steam or pressurized steam may be used. The temperature to which the fabric is heated will vary significantly depending upon the composition and resulting crystallinity characteristics of the substrate. Thus, it has been found that, for instance, nylon 6 pile fibers may be heated to a preferred temperature range of from about 120° F. to about 180° F., while nylon 66 may be heated to somewhat higher temperatures of, for instance, about 160° F. to about 250° F. Wool fibers may be heated to temperatures ranging from about 200° F. to about 250° F., preferably 210° F. to 240° F.

Generally, the pile fabric may be subjected to heating for a time sufficient to cause degradation of the selected portions of the pile fabric. Where the heating means is steam, it has been found that heating should be for at least about one minute, preferably about three to about 30 minutes. The time of heating and the temperature of the atmosphere should be adjusted to result in the desired degree of degradation for the particular fiber substrate. Thus, if the temperature is too low or if the time of treatment is too short, insufficient degradation will occur to allow for subsequent removal of the pile by mechanical means. If the temperature is too high, both the pile and the fiber degrading agent may completely decompose (rather than degrade, e.g., partially hydrolyze) which will result in an undesirable product having an unpleasant hand in the embossed areas.

After steaming the pile fabric may be washed, preferably with water, to remove any residual components of the fiber degrading composition from the pile fabric. It has been found that the wash water should preferably be maintained at a temperature of from about 0° C. to about 40° C., preferably about 10° C. to about 30° C. although other temperatures may be employed. After washing the fabric may be dried by conventional means.

As mentioned above, the selected areas of the pile fabric to which the pile degrading agent has been applied may be removed by mechanical means. Mechanical action to cause such removal may be initiated or even be accomplished totally during the washing step described above by simply spraying the washing solution onto the entire surface of the substrate at a high velocity. Alternatively the mechanical means by which the degraded portions are removed may be a simple beater which applies such action to the entire surface of the fabric from which degraded fibers are to be removed. In general the degree of mechanical action will depend upon the resultant tensile strength of the fiber after degradation in the areas to be sculptured. Mechanical removal of the degraded pile may be performed during the washing step as mentioned above or alternatively after washing but prior to drying or even after drying of the fabric.

A large number of products can be produced by the process of the present invention. The products can be used for floor, wall and ceiling coverings, drapery, upholstery and the like, and, in fact wherever pile fabrics are utilized. They are readily adaptable to decorating any surface on which pile fabrics can be applied. Many additional applications will occur to those skilled in the art.

The following examples are provided for illustrative purposes only and are not to be construed as limiting the subject matter of the invention in any way. Unless otherwise indicated, all parts and percentages are by weight.

EXAMPLE 1

In this example the fiber degrading composition contained 40 percent by weight para-toluenesulfonic acid, 0.5 percent Xanthan gum, 0.5 Levalin VKU which is a blend of anionic and nonionic surfactants available from Mobay Chemical Co., and 0.5 percent acid dye. The remainder of the composition was water present as a diluent. The process was performed on a nylon material (Monsanto's Ultron Type 66 Spun Nylon two ply yarn, 10 denier) which was in the form of a tufted carpet with a 1/10 inch tufting gauge, pile height of 39/64 inch, and 48 ounces per square yard.

The fabric was wetted to approximately 80 percent pickup with an aqueous solution thickened with Xanthan gum to enhance the levelness of coexisting dyeing of the fabric. The fiber degrading composition was applied on preselected areas of the fabric at approximately 200 percent wet pickup based on the face weight of the selected areas of the fabric. Application of the composition was by means of the apparatus described in U.S. Pat. No. 4,084,615. The fabric was then steamed at 212° F. for ten minutes to activate the reaction between the fiber and the sculpturing liquor and to fix the dye. It was then washed with water at a temperature of about 70° F. to remove any chemicals and thickening agents present on the fabric. Then prior to drying a mechanical beating action was applied to the entire fabric surface; the fabric was then dried and finished according to standard techniques used for textile printing.

During and after the process the following observations were made:

(1) There was no reduction in pile height in the sculptured areas or weight loss observed prior to steaming.

(2) A slight reduction of about 10 percent to 20 percent in pile height in the sculptured areas was noticed after steaming. In the selected areas to be sculptured, fiber integrity was not altered but fiber tensile strength was dramatically reduced.

(3) Washing with cold water immediately after steaming seemed to assist in the removal of the degraded pile fibers.

(4) After face beating the fabric pile height in the sculptured areas was reduced approximately 80 percent.

(5) The remaining yarn in the sculptured areas maintained complete fiber integrity and had substantially the same hand characteristics as the untreated yarns of the pile fabric.

EXAMPLE 2

Example 1 was repeated except that the concentration of paratoluene sulfonic acid in the fiber degrading composition was increased from 40 percent to 48 percent. Shrinkage and loss of fiber identity were observed before steaming, and a molten polymer residue was formed during steaming which, when cooled became hard and crust-like and could not be removed.

EXAMPLE 3

Example 1 was repeated except that the concentration of paratoluene sulfonic acid in the fiber degrading composition was decreased to 33 percent from 40 percent. After steaming only 10 percent pile height reduction was observed and there was no removal of any portion of the pile possible in the treated areas by means of face beating. Microscopic analysis revealed only slight fiber shrinkage.

EXAMPLES 4 AND 5

Example 1 was repeated except that the fiber degrading composition contained 40 percent sulfuric acid rather than paratoluenesulfonic acid for Example 4 and 40 percent formic acid for Example 5. Complete fiber dissolution was observed resulting in a crust-like hard mass of polymer that could not be removed.

EXAMPLE 6

In this example the procedure set forth in Example 1 was repeated on a different pile fabric. The fabric was a nylon (Staple Nylon 66, 4 inch spun, two-ply yarn) material in the form of a bonded carpet with a 1/9 inch square, pile height of ¼ inch and 28 ounces per square yard. Substantially the same result was achieved as in Example 1, the only difference being that the reduction of the pile height was about 50 percent rather than 80 percent.

EXAMPLE 7

Example 1 was repeated on a 100 percent Anso Nylon 6 (Allied) yarn (15 denier) which was in the form of a tufted carpet with a 1/10 inch tufting gauge, pile height of 13/16 inch, and weight of 34 ounces per yard. Observations were identical to those set forth for Example 1 except that virtually all of the pile in the designated area was removed.

EXAMPLE 8

Example 1 was repeated except that the fabric was an 80 percent New Zealand Wool, 20 percent nylon 66 (single ply) 1/10 gauge, 15.6 stitches per inch, 21/64 inch pile height, 34 ounces per yard. Very slight reduction in pile height was observed. The wool remained intact but the nylon was removed.

EXAMPLE 9

Example 8 was repeated, except that the fabric was steamed under pressure at 230° F. rather than at 212° F. Both the wool and nylon were degraded to the extent that they were easily brushed off as a powder after the washing step.

What is claimed is:

1. A process for sculpturing a pile fabric having pile fibers selected from nylon, wool, nylon-wool blends which comprises selectively contacting the pile surface of said pile fabric with from about 150 percent to about 250 percent by weight based upon the weight of said fabric substrate contacted of a fiber degrading agent; said fiber degrading composition comprising from about 20 percent to about 50 percent by weight based upon the weight of said composition of para-toluenesulfonic acid, an aqueous diluent for said para-toluenesulfonic acid and a thickening agent in an amount sufficient to provide a viscosity of from about 100 to about 1,000 cps: heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the pile integrity prior to removal by mechanical means; and removing said degraded portion of said pile fibers by mechanical means to provide a sculptured pile fabric.

2. The process of claim 1, wherein said nylon is prepared by the condensation of hexamethylenediamine and adipic acid.

3. The process of claim 1, wherein said heating is caused by the application of steam for at least about one minute.

4. The process of claim 3, wherein said pile fabric is washed after heating, said wash water being maintained at a temperature of from about 0° C. to about 40° C.

5. The process of claim 4, wherein said pile fabric is dried after removal of said degraded portion of said pile fibers by mechanical means.

6. The process of claim 4, wherein said pile fabric is dried prior to removal of said degraded portion of said pile fibers by mechanical means.

7. The process of claim 4, wherein the removal of said degraded portion of said pile fibers by mechanical means is accomplished during the washing step by mechanical action of said wash water.

8. A process for sculpturing a pile fabric characterized as having pile fibers selected from nylon, wool and nylon-wool blends with a fiber degrading composition, which comprises selectively contacting the pile surface of said pile fabric with from about 150 to about 250 percent by weight based upon the weight of said fabric substrate of a fiber degrading composition, said selective contacting being accomplished by means of a jet dyeing apparatus including conveying means for transporting the fabric, jet orifices for delivering fiber degrading composition in a pattern to said textile material and controlling means for supplying data to control the operation of the application of fiber degrading composition from the jet orifices to the fabric, said fiber degrading composition comprising from about 20 percent to about 50 percent by weight para-toluenesulfonic acid, an aqueous diluent for said para-toluenesulfonic acid, and a thickening agent in an amount sufficient to provide a viscosity of from about 100 to about 1,000 cps; said process further comprising the steps of heating said pile fabric to a temperature sufficient to cause the tensile strength of said fibers of said pile on the selected areas to be reduced sufficiently so that said fibers may be removed by mechanical means, but said temperature being low enough so as not to result in the complete destruction of the fiber integrity prior to removal by mechanical means; and removing said degraded portion of said pile fibers by mechanical means to provide a sculptured pile fabric.

9. The process of claim 8, wherein said nylon is prepared by the condensation of hexamethylenediamine and adipic acid.

10. The process of claim 8, wherein said diluent is water.

11. The process of claim 8, wherein said heating is caused by the application of steam for at least about one minute.

12. The process of claim 8, wherein said pile fabric is washed after heating, said wash water being maintained at a temperature of from about 0° C. to about 40° C.

13. The process of claim 8, wherein said pile fabric is dried after removal of said degraded portion of said pile fabric by mechanical means.

14. The process of claim 8, wherein said pile fabric is dried prior to removal of said degraded portion of said pile fibers by mechanical means.

15. The process of claim 8, wherein the removal of said degraded portion of said pile fibers by mechanical means is accomplished during the washing step by mechanical action of said wash water.

* * * * *